US010539899B2

(12) United States Patent
Nakamura et al.

(10) Patent No.: US 10,539,899 B2
(45) Date of Patent: Jan. 21, 2020

(54) TONER

(71) Applicant: CANON KABUSHIKI KAISHA, Tokyo (JP)

(72) Inventors: Kunihiko Nakamura, Gotemba (JP); Kenta Kamikura, Yokohama (JP); Maho Tanaka, Tokyo (JP); Yusuke Kosaki, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/250,218

(22) Filed: Jan. 17, 2019

(65) Prior Publication Data

US 2019/0235407 A1 Aug. 1, 2019

(30) Foreign Application Priority Data

Jan. 26, 2018 (JP) ..... 2018-011259

(51) Int. Cl.
*G03G 9/08* (2006.01)
*G03G 9/097* (2006.01)
*G03G 9/087* (2006.01)

(52) U.S. Cl.
CPC ..... *G03G 9/09708* (2013.01); *G03G 9/0819* (2013.01); *G03G 9/08711* (2013.01)

(58) Field of Classification Search
CPC ..... G03G 9/09708
USPC ..... 430/108.3
See application file for complete search history.

(56) References Cited

U.S. PATENT DOCUMENTS

| | | | |
|---|---|---|---|
| 7,858,283 | B2 | 12/2010 | Ishigami et al. |
| 7,927,775 | B2 | 4/2011 | Komatsu et al. |
| 7,939,233 | B2 | 5/2011 | Inoue et al. |
| 8,137,886 | B2 | 3/2012 | Baba et al. |
| 8,142,972 | B2 | 3/2012 | Hotta et al. |
| 8,288,069 | B2 | 10/2012 | Fujikawa et al. |
| 8,828,639 | B2 | 9/2014 | Kamikura et al. |
| 8,986,914 | B2 | 3/2015 | Fujikawa et al. |
| 9,034,549 | B2 | 5/2015 | Shiotari et al. |
| 9,261,806 | B2 | 2/2016 | Moribe et al. |
| 9,285,697 | B2 | 3/2016 | Fukudome et al. |
| 9,309,349 | B2 | 4/2016 | Watanabe et al. |
| 9,423,708 | B2 | 8/2016 | Tominaga et al. |
| 9,429,860 | B2 | 8/2016 | Kinumatsu et al. |
| 9,594,323 | B2 | 3/2017 | Fujikawa et al. |
| 9,658,554 | B2 | 5/2017 | Kinumatsu et al. |
| 9,798,256 | B2 | 10/2017 | Kosaki et al. |
| 9,798,262 | B2 | 10/2017 | Toyoizumi et al. |
| 9,811,016 | B2 | 11/2017 | Aoki et al. |
| 9,823,595 | B2 | 11/2017 | Toyoizumi et al. |
| 9,829,820 | B2 | 11/2017 | Masumoto et al. |
| 9,857,713 | B2 | 1/2018 | Kosaki et al. |

(Continued)

FOREIGN PATENT DOCUMENTS

| | | |
|---|---|---|
| JP | 2006-072199 | 3/2006 |
| JP | 2012-208409 | 10/2012 |

OTHER PUBLICATIONS

U.S. Appl. No. 16/253,976, Maho Tanaka, filed Jan. 22, 2019.
U.S. Appl. No. 16/253,999, Kenta Kamikura, filed Jan. 22, 2019.

*Primary Examiner* — Mark A Chapman
(74) *Attorney, Agent, or Firm* — Venable LLP

(57) ABSTRACT

A toner comprising a toner particle that contains a binder resin, wherein the surface of the toner particle has a reaction product of a polyhydric acid and a compound that contains a group 4 element.

8 Claims, 2 Drawing Sheets

(56) References Cited

U.S. PATENT DOCUMENTS

| | | | | |
|---|---|---|---|---|
| 9,869,943 | B2 | 1/2018 | Aoki et al. | |
| 9,880,478 | B2 | 1/2018 | Shimano et al. | |
| 9,897,933 | B2 | 2/2018 | Yoshida et al. | |
| 9,921,501 | B2 | 3/2018 | Mochizuki et al. | |
| 2009/0233212 | A1 | 9/2009 | Fujikawa et al. | |
| 2009/0246675 | A1 | 10/2009 | Nakamura et al. | |
| 2010/0028796 | A1 | 2/2010 | Nakamura et al. | |
| 2010/0143836 | A1* | 6/2010 | Miyamoto ..... | G03G 9/081 430/111.4 |
| 2010/0183971 | A1 | 7/2010 | Fujikawa et al. | |
| 2018/0231901 | A1 | 8/2018 | Koji et al. | |
| 2018/0246430 | A1 | 8/2018 | Tanaka et al. | |
| 2018/0246431 | A1* | 8/2018 | Hashimoto ..... | C01G 23/005 |
| 2018/0246432 | A1 | 8/2018 | Nishikawa et al. | |
| 2018/0329320 | A1 | 11/2018 | Yoshida et al. | |
| 2018/0329321 | A1 | 11/2018 | Nakamura et al. | |
| 2018/0329322 | A1 | 11/2018 | Kamikura et al. | |
| 2018/0329324 | A1 | 11/2018 | Kamikura et al. | |
| 2018/0329325 | A1 | 11/2018 | Hatakeyama et al. | |
| 2018/0329327 | A1 | 11/2018 | Yamawaki et al. | |
| 2018/0329328 | A1 | 11/2018 | Tanaka et al. | |
| 2018/0329329 | A1 | 11/2018 | Nakamura et al. | |
| 2018/0329332 | A1 | 11/2018 | Tominaga et al. | |

* cited by examiner

TONER

BACKGROUND OF THE INVENTION

Field of the Invention

The present invention relates to a toner used in image-forming methods such as electrophotography and electrostatic printing.

Description of the Related Art

Due to the development of computers and multimedia, there has been desire across a broad range of sectors from the office to the home for means of outputting high-definition full color images, and additional improvements in toner performance are thus required.

For example, a toner that exhibits a rapid charge rise is required in order to make it possible for printing to start immediately after printer power up.

Moreover, in order to achieve image stability when a large number of prints are made of a low print density image, a toner is required for which the phenomenon of a continuing rise in the amount of charge (charge up) is inhibited.

In addition, a toner that exhibits little fluctuation with respect to the environment, i.e., air temperature and humidity (has an excellent environmental stability) is required.

Various investigations have been carried out in order to achieve these properties.

A toner having an improved charge rise is disclosed in Japanese Patent Application Laid-open No. 2006-72199; this achieved by the use of a hydrophobic titanium oxide in combination with a resin charge control agent.

A toner having a stable charging performance on a long-term basis is disclosed in Japanese Patent Application Laid-open No. 2012-208409; this is achieved by the use of silica particles in combination with particles of a calcium phosphate-type compound.

SUMMARY OF THE INVENTION

The toner described in Japanese Patent Application Laid-open No. 2006-72199 uses a charge control resin that uses a sulfonate salt group-bearing monomer and an electron-withdrawing group-bearing aromatic monomer in combination with an acrylate ester monomer and/or a methacrylate ester monomer. The use of this charge control resin brings about an improved environmental stability while maintaining the charging performance. At the same time, charge up is suppressed through the use of hydrophobically treated titanium oxide fine particles in which the amount of water-soluble component is at least 0.2 wt %.

However, the charge quantity did undergo a decline in a high-humidity environment in investigations carried out by the present inventors.

This is thought to be due to the hygroscopicity of the water-soluble component of the titanium oxide fine particles, while at the same time the hygroscopicity of the sulfonate salt group in the charge control resin cannot be completely suppressed.

In particular, the water-soluble component of the titanium oxide fine particles is the essential component for establishing a low resistance for the titanium oxide. Due to this, a trade-off relationship exists between the suppression of charge up, which is achieved by having the resistance be low, and the reduction in the charge quantity in a high-humidity environment due to moisture absorption by the water-soluble component, and their co-existence is considered to be highly problematic.

The toner of Japanese Patent Application Laid-open No. 2012-208409 provides an improved charging performance through the use of particles of a calcium phosphate-type compound.

However, the hygroscopicity of the calcium phosphate-type compound can cause a decline in the charging performance in high-humidity environments.

The present invention was achieved in view of these circumstances and provides a toner that exhibits excellent charging characteristics.

Specifically, the present invention provides a toner that exhibits an excellent charge rise performance, an excellent environmental stability, and a suppression of charge up.

The present invention relates to a toner comprising a toner particle that contains a binder resin, wherein the surface of the toner particle has a reaction product of a polyhydric acid and a compound containing a group 4 element.

The present invention can thus provide a toner that exhibits an excellent charge rise performance, an excellent environmental stability, and a suppression of charge up.

Further features of the present invention will become apparent from the following description of exemplary embodiments with reference to the attached drawings.

DESCRIPTION OF THE EMBODIMENTS

Figure 1:
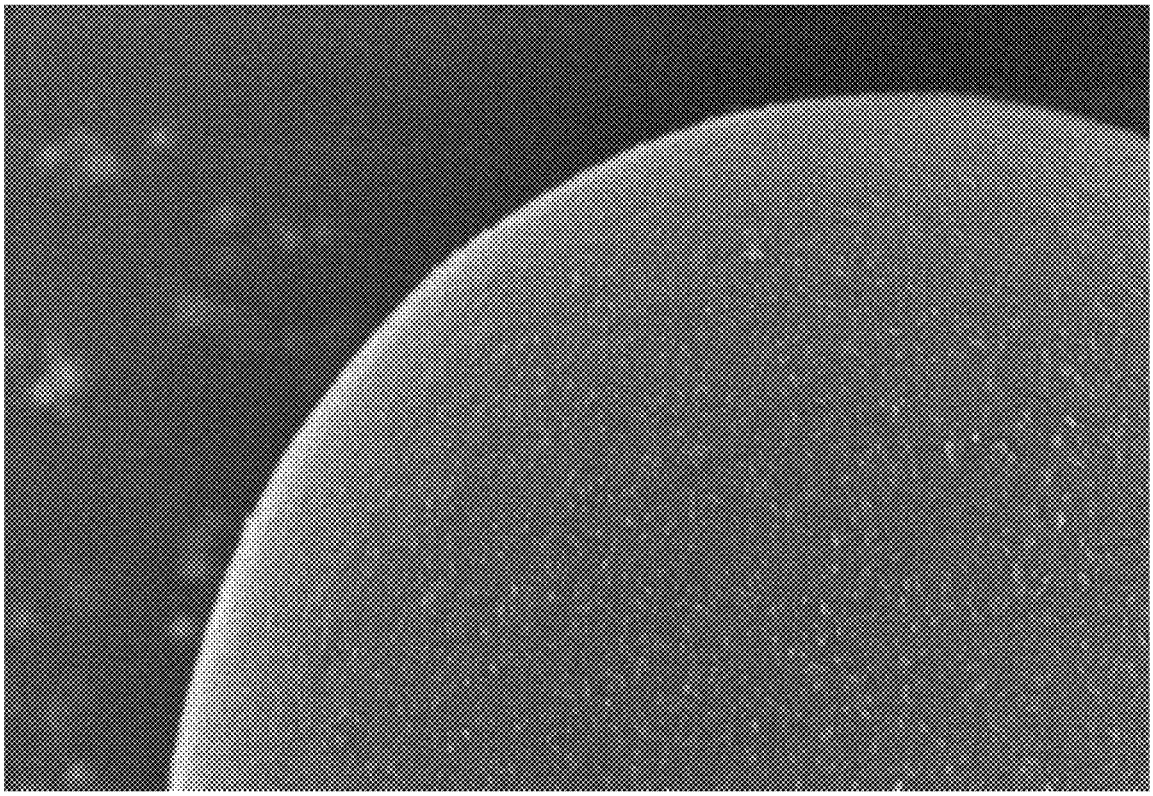
FIG. 1 is a scanning electron micrograph of a toner particle (photograph in lieu of drawing)

Unless specifically indicated otherwise, the expressions "from XX to YY" and "XX to YY" that show numerical value ranges refer in the present invention to numerical value ranges that include the lower limit and upper limit that are the end points.

The present invention is a toner comprising a toner particle that contains a binder resin, wherein the surface of the toner particle has a reaction product of a polyhydric acid and a compound containing a group 4 element.

A summary of the present invention is described below.

The inventors investigated a variety of materials in order to provide a toner that exhibits an excellent charge rise performance, an excellent environmental stability, and a suppression of charge up.

Among these materials, the reaction products of a polyhydric acid and a compound containing a group 4 element were discovered to be materials that provided toner with an excellent charge rise performance, an excellent environmental stability, and an excellent suppression of charge up.

The mechanisms for this are hypothesized to be the following.

The polyhydric acid readily takes on a negative charge by accepting an electron pair. As a consequence, the reaction product between the polyhydric acid and the group 4 element-containing compound also readily assumes a negative charge and thus exhibits an excellent charging performance.

Moreover, an oxidation number of +4 is the most stable state for group 4 elements. As a consequence, a crosslinked structure is produced with the polyhydric acid, and electron movement is then promoted by this crosslinked structure and an improvement in the charge rise performance and a suppression of charge up can be achieved as a result.

The reaction product between the polyhydric acid and the group 4 element-containing compound also provides an excellent environmental stability through a blocking of water molecules by the crosslinked structure.

Thus, through the conversion of the polyhydric acid and group 4 element-containing compound into a reaction product, a performance can be achieved for the first time that cannot be achieved just through the use of a separate polyhydric acid-containing compound or a separate group 4 element-containing compound, respectively.

That is, the three properties that have heretofore been in a trade-off relationship in toner, i.e., the charge rise performance, the environmental stability, and charge up suppression, can be simultaneously established through the promotion of electron movement and the water molecule blockage that are brought about by a strong crosslinked structure.

The properties of this reaction product are not disclosed in Japanese Patent Application Laid-open No. 2012-208409, which describes a polyhydric acid salt with other than a group 4 element.

The reaction product of a polyhydric acid and a group 4 element-containing compound also has an effect with respect to preventing member contamination.

The authors believe that the reason for this is that the reaction product between a polyhydric acid and a group 4 element-containing compound is strongly attached to the toner particle surface.

Anionic functional groups (carboxy groups) and/or cationic functional groups (amino groups) are present on the toner particle surface. On the other hand, functional groups due to the polyhydric acid and/or functional groups originating with the group 4 element are also present on the surface of the reaction product between a polyhydric acid and a group 4 element-containing compound. It is believed that the reaction product between a polyhydric acid and a group 4 element-containing compound can be strongly attached to the toner particle surface due to a strong attraction between these functional groups on the toner particle surface and the surface functional groups of the polyhydric acid and the group 4 element-containing compound.

On the other hand, the conventionally used titanium oxide ($TiO_2$) is an extremely stable compound and as a consequence cannot produce a reaction product with a polyhydric acid and the charging performance is then low. The suppression of charge up is also unsatisfactory.

In addition, the inhibition of moisture adsorption has been inadequate in the case of polyhydric acid salts with other than a group 4 element, for example, polyhydric acid salts with alkaline-earth metals.

The specific constitution of the present invention is described in the following.

The polyhydric acid may be any acid that is an at least dibasic acid. Specific examples are as follows:

inorganic acids such as phosphoric acid, carbonic acid, and sulfuric acid; and organic acids such as dicarboxylic acids and tricarboxylic acids.

Specific examples of the organic acids are as follows:

dicarboxylic acids such as oxalic acid, malonic acid, succinic acid, glutaric acid, adipic acid, fumaric acid, maleic acid, pimelic acid, suberic acid, azelaic acid, sebacic acid, phthalic acid, isophthalic acid, and terephthalic acid; and tricarboxylic acids such as citric acid, aconitic acid, and trimellitic anhydride.

Among the preceding, the polyhydric acid preferably includes at least one selected from the group consisting of carbonic acid, sulfuric acid, and phosphoric acid, because this results in a strong reaction with the group 4 element and impedes moisture absorption. The polyhydric acid more preferably includes phosphoric acid.

A polyhydric acid may be used as such as the polyhydric acid, or the polyhydric acid may be used in the form of its salt with an alkali metal such as sodium, potassium, and lithium; or its salt with an alkaline-earth metal such as magnesium, calcium, strontium, and barium; or as an ammonium salt of the polyhydric acid.

The group 4 element-containing compound may be any group 4 element-containing compound and there are no particular limitations thereon.

The group 4 element can be exemplified by titanium, zirconium, and hafnium.

Among the preceding, the group 4 element preferably includes at least one of titanium and zirconium.

Specific examples of titanium-containing compounds are as follows:

titanium alkoxides such as tetraisopropyl titanate, tetrabutyl titanate, and tetraoctyl titanate; and titanium chelates such as titanium diisopropoxybisacetylacetonate, titanium tetraacetylacetonate, titanium diisopropoxybis(ethyl acetoacetate), titanium di-2-ethylhexoxybis(2-ethyl-3-hydroxyhexoxide), titanium diisopropoxybisethyl acetoacetate, titanium lactate, ammonium salt of titanium lactate, titanium diisopropoxybistriethanolaminate, titanium isostearate, titanium aminoethylaminoethanolate, and titanium triethanolaminate.

Among the preceding, titanium chelates are preferred because they facilitate reaction with the polyhydric acid. Titanium lactate and the ammonium salt of titanium lactate are more preferred.

Specific examples of zirconium-containing compounds are as follows:

zirconium alkoxides such as zirconium tetrapropoxide and zirconium tetrabutoxide; and zirconium chelates such as zirconium tetraacetylacetonate, zirconium tributoxymonoacetylacetonate, zirconium dibutoxybis(ethyl acetoacetate), zirconium lactate, and the ammonium salt of zirconium lactate.

Among the preceding, zirconium chelates are preferred because they facilitate reaction with the polyhydric acid. Zirconium lactate and the ammonium salt of zirconium lactate are more preferred.

Specific examples of hafnium-containing compounds are as follows:

hafnium chelates such as hafnium lactate and the ammonium salt of hafnium lactate.

The phrase "the surface of the toner particle has a reaction product of a polyhydric acid and a compound that contains a group 4 element" refers, for example, to a state in which the reaction product of a polyhydric acid and group 4 element-containing compound is present on the toner particle surface.

Various heretofore known methods can be used to bring about the presence of the reaction product of a polybasic and group 4 element-containing compound on the toner particle surface, and the following method is provided as an example.

A method in which the toner particle is obtained by reacting the polyhydric acid with the group 4 element-containing compound in a dispersion of the toner base particle and causing the obtained reaction product to attach to the surface of the toner base particle.

For example, the polyhydric acid may be reacted with the group 4 element-containing compound by adding the polyhydric acid and group 4 element-containing compound to, and mixing same with, a dispersion of the toner base particle, and, by having stirred the dispersion at the same time that the reaction product is obtained, causing attachment to the surface of the toner base particle to yield the toner particle.

In an example of another method, the polyhydric acid may be reacted with the group 4 element-containing compound to produce reaction product-containing fine particles, and, by mixing these with the toner base particle, the reaction product-containing fine particles may be attached to the toner base particle surface to obtain the toner particle.

Specifically, the toner base particle may be mixed with the reaction product fine particles using a high-speed stirrer that imparts shear force, e.g., an FM mixer, Mechano-Hybrid (Nippon Coke & Engineering Co., Ltd.), Super Mixer, and Nobilta (Hosokawa Micron Corporation).

The reaction product of the polyhydric acid with the group 4 element-containing compound can be obtained by reacting the polyhydric acid and group 4 element-containing compound in a solvent.

Any solvent may be used here.

Specific examples of the solvent are as follows:

hexane, benzene, toluene, diethyl ether, chloroform, ethyl acetate, tetrahydrofuran, acetone, acetonitrile, N,N-dimethylformamide, 1-butanol, 1-propanol, 2-propanol, methanol, ethanol, and water.

There are no particular limitations on the reaction product of the polyhydric acid and a group 4 element-containing compound. However, the following are preferred from the standpoint of suppressing image deterioration during long print runs: at least one selected from the group consisting of the reaction products of sulfuric acid and a titanium-containing compound, the reaction products of carbonic acid and a titanium-containing compound, the reaction products of phosphoric acid and a titanium-containing compound, the reaction products of sulfuric acid and a zirconium-containing compound, the reaction products of carbonic acid and a zirconium-containing compound, and the reaction products of phosphoric acid and a zirconium-containing compound.

At least one of the reaction products of phosphoric acid and a titanium-containing compound and the reaction products of phosphoric acid and a zirconium-containing compound is more preferred.

The number-average particle diameter of the fine particles containing the reaction product of the polyhydric acid and group 4 element-containing compound is preferably from 1 nm to 400 nm, more preferably from 1 nm to 200 nm, and still more preferably from 1 nm to 60 nm.

Member contamination due to liberation of the fine particles can be suppressed by having the number-average particle diameter of the fine particles be in the indicated range.

Factors that can be used to adjust the number-average particle diameter of the fine particles into the indicated range are, for example, the amounts of addition of the polyhydric acid and group 4 element-containing compound, which are the starting materials for the fine particles, as well as the pH when these are reacted and the temperature during the reaction.

The content of the reaction product of the polyhydric acid and group 4 element-containing compound in the toner particle is preferably from 0.01 mass % to 5.00 mass % and is more preferably from 0.02 mass % to 3.00 mass %.

The organosilicon compound represented by formula (1) below is preferably also used when the toner particle is obtained by reacting the polyhydric acid and group 4 element-containing compound in a dispersion of the toner base particle and attaching the obtained reaction product to the surface of the toner base particle.

Through the co-use of this organosilicon compound, the obtained reaction product is more strongly anchored to the toner particle, plus the reaction product of the polyhydric acid and group 4 element-containing compound is also hydrophobed and the environmental stability is then further improved.

Specifically, the organosilicon compound represented by formula (1) below first is hydrolyzed in advance or hydrolyzed in the toner base particle dispersion.

The resulting organosilicon compound hydrolyzate is subsequently condensed to make a condensate.

This condensate transfers to the toner particle surface. Because this condensate is viscous or sticky, this causes the reaction product between the polyhydric acid and group 4 element-containing compound to adhere to the toner particle surface and can thus bring about a stronger anchorage of the reaction product to the toner particle.

This condensate also transfers to the surface of the reaction product and hydrophobes the reaction product and can thus further improve the environmental stability.

$$R_{a(n)}—Si—R_{b(4-n)} \quad (1)$$

In formula (1), $R_a$ represents a halogen atom or alkoxy group, and $R_b$ represents an alkyl group, alkenyl group, aryl group, acyl group, or methacryloxyalkyl group. n represents an integer from 2 to 4. When a plurality of $R_a$ functional groups are present, the plurality of $R_a$ functional groups may be the same or different from one another; when a plurality of $R_b$ substituents are present, the plurality of $R_b$ substituents may be the same or different from one another.

In the following, the $R_a$ in formula (1) is referred to as a functional group and $R_b$ is referred to as a substituent.

There are no particular limitations on the organosilicon compound represented by formula (1), and known organosilicon compounds can be used. Specific examples are the following difunctional silane compounds having two functional groups, trifunctional silane compounds having three functional groups, and tetrafunctional silane compounds having four functional groups.

The difunctional silane compounds can be exemplified by dimethyldimethoxysilane and dimethyldiethoxysilane.

The trifunctional silane compounds can be exemplified by the following:

trifunctional silane compounds bearing an alkyl group as the substituent, such as methyltrimethoxysilane, methyltriethoxysilane, methyldiethoxymethoxysilane, methylethoxydimethoxysilane, ethyltrimethoxysilane, ethyltriethoxysilane, propyltrimethoxysilane, propyltriethoxysilane, butyltrimethoxysilane, butyltriethoxysilane, hexyltrimethoxysilane, hexyltriethoxysilane, octyltrimethoxysilane, octyltriethoxysilane, decyltrimethoxysilane, and decyltriethoxysilane;

trifunctional silane compounds bearing an alkenyl group as the substituent, such as vinyltrimethoxysilane, vinyltriethoxysilane, allyltrimethoxysilane, and allyltriethoxysilane;

trifunctional silane compounds bearing an aryl group as the substituent, such as phenyltrimethoxysilane and phenyltriethoxysilane; and trifunctional silane compounds bearing a methacryloxyalkyl group as the substituent, such as γ-methacryloxypropyltrimethoxysilane, γ-methacryloxypropyltriethoxysilane, γ-methacryloxypropyldiethoxymethoxysilane, and γ-methacryloxypropyl ethoxydimethoxysilane.

Tetramethoxysilane, tetraethoxysilane, tetrapropoxysilane, and tetrabutoxysilane are examples of tetrafunctional silane compounds.

The content of the condensate of the at least one organosilicon compound selected from the group consisting of organosilicon compounds represented by formula (1) in the toner particle is preferably from 0.1 mass % to 20.0 mass % and is more preferably from 0.5 mass % to 15.0 mass %.

The method for producing the toner base particle is not particularly limited, and a known suspension polymerization method, dissolution suspension method, emulsion aggregation method, pulverization method, and so forth can be used.

When the toner base particle has been produced in an aqueous medium, this may be used as such for the toner base particle dispersion for placing the reaction product of the polyhydric acid and group 4 element-containing compound on the toner particle surface. In addition, the toner base particle dispersion may be acquired by washing, filtration, drying, and then redispersion in an aqueous medium.

When, on the other hand, the toner base particle has been produced by a dry method, the toner base particle dispersion may be made by dispersion in an aqueous medium using a known method. The aqueous medium preferably contains a dispersion stabilizer in order to effect the dispersion of the toner base particle in the aqueous medium.

The production of the toner base particle using a suspension polymerization method is described as a specific example in the following.

First, the polymerizable monomer that will produce the binder resin is mixed with any optional additives, and, using a disperser, a polymerizable monomer composition is prepared in which these materials are dissolved or dispersed.

The additives can be exemplified by colorants, waxes, charge control agents, polymerization initiators, chain transfer agents, and so forth.

The disperser can be exemplified by homogenizers, ball mills, colloid mills, or ultrasound dispersers.

The polymerizable monomer composition is then introduced into an aqueous medium that contains sparingly water-soluble inorganic fine particles, and droplets of the polymerizable monomer composition are prepared using a high-speed disperser such as a high-speed stirrer or an ultrasound disperser (granulation step).

The toner base particle is then obtained by polymerizing the polymerizable monomer in the droplets (polymerization step).

The polymerization initiator may be admixed during the preparation of the polymerizable monomer composition or may be admixed into the polymerizable monomer composition immediately prior to the formation of the droplets in the aqueous medium.

In addition, it may also be added, optionally dissolved in the polymerizable monomer or another solvent, during granulation into the droplets or after the completion of granulation, i.e., immediately before the initiation of the polymerization reaction.

After resin particles have been obtained by the polymerization of the polymerizable monomer, the toner base particle dispersion may be obtained by the optional execution of a solvent removal process.

The binder resin can be exemplified by the following resins or polymers:

vinyl resins, polyester resins, polyamide resins, furan resins, epoxy resins, xylene resins, and silicone resins.

Vinyl resins are preferred among the preceding. Vinyl resins can be exemplified by polymers or copolymers of the monomers indicated below. Among these, copolymers between a styrenic monomer and an unsaturated carboxylic acid ester are preferred.

Styrene and styrenic monomers such as α-methylstyrene; unsaturated carboxylic acid esters such as methyl acrylate, butyl acrylate, methyl methacrylate, 2-hydroxyethyl methacrylate, t-butyl methacrylate, and 2-ethylhexyl methacrylate; unsaturated carboxylic acids such as acrylic acid and methacrylic acid; unsaturated dicarboxylic acids such as maleic acid; unsaturated dicarboxylic acid anhydrides such as maleic anhydride; nitrile-type vinyl monomers such as acrylonitrile; halogenated vinyl monomers such as vinyl chloride; and nitro-type vinyl monomers such as nitrostyrene.

The black pigments, yellow pigments, magenta pigments, cyan pigments, and so forth provided as examples in the following can be used as the colorant.

The black pigments can be exemplified by carbon blacks.

The yellow pigments can be exemplified by monoazo compounds, disazo compounds, condensed azo compounds, isoindolinone compounds, isoindoline compounds, benzimidazolone compounds, anthraquinone compounds, azo metal complexes, methine compounds, and allylamide compounds.

Specific examples are C. I. Pigment Yellow 74, 93, 95, 109, 111, 128, 155, 174, 180, and 185.

The magenta pigments can be exemplified by monoazo compounds, condensed azo compounds, diketopyrrolopyrrole compounds, anthraquinone compounds, quinacridone compounds, basic dye lake compounds, naphthol compounds, benzimidazolone compounds, thioindigo compounds, and perylene compounds.

Specific examples are C. I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254, and 269, and C. I. Pigment Violet 19.

The cyan pigments can be exemplified by copper phthalocyanine compounds and derivatives thereof, anthraquinone compounds, and basic dye lake compounds.

Specific examples are C. I. Pigment Blue 1, 7, 15, 15:1, 15:2, 15:3, 15:4, 60, 62, and 66.

Various dyes heretofore known as colorants may be used in combination with the pigments.

The content of the colorant is preferably from 1.0 mass parts to 20.0 mass parts per 100 mass parts of the binder resin.

The toner may also be made into a magnetic toner through the incorporation of a magnetic body. In this case, the magnetic body may also function as a colorant.

The magnetic body can be exemplified by iron oxides as represented by magnetite, hematite, and ferrite; metals as represented by iron, cobalt, and nickel; or alloys of these metals with a metal such as aluminum, cobalt, copper, lead, magnesium, tin, zinc, antimony, beryllium, bismuth, cadmium, calcium, manganese, selenium, titanium, tungsten, and vanadium; and mixtures thereof.

The waxes can be exemplified by the following:

esters between a monohydric alcohol and an aliphatic monocarboxylic acid or esters between a monobasic carboxylic acid and an aliphatic monoalcohol, such as behenyl behenate, stearyl stearate, and palmityl palmitate; esters between a dihydric alcohol and an aliphatic monocarboxylic acid or esters between a dibasic carboxylic acid and an aliphatic monoalcohol, such as dibehenyl sebacate and hexanediol dibehenate; esters between a trihydric alcohol and an aliphatic monocarboxylic acid or esters between a tribasic carboxylic acid and an aliphatic monoalcohol, such as glycerol tribehenate; esters between a tetrahydric alcohol and an aliphatic monocarboxylic or and esters between a tetrabasic carboxylic acid and an aliphatic monoalcohol, such as pentaerythritol tetrastearate and pentaerythritol tetrapalmitate; esters between a hexahydric alcohol and an aliphatic monocarboxylic acid or esters between a hexabasic carboxylic acid and an aliphatic monoalcohol, such as dipentaerythritol hexastearate and dipentaerythritol hexapalmitate; esters between a polyhydric alcohol and an aliphatic monocarboxylic acid or esters between a polybasic carboxylic acid and an aliphatic monoalcohol, such as polyglycerol behenate; natural ester waxes such as carnauba wax and rice wax; petroleum waxes such as paraffin waxes, microcrystalline waxes, and petrolatum, and derivatives thereof; hydrocarbon waxes provided by the Fischer-Tropsch method, and derivatives thereof; polyolefin waxes such as polyethylene waxes and polypropylene waxes, and derivatives thereof; higher aliphatic alcohols; fatty acids such as stearic acid and palmitic acid; and acid amide waxes.

The content of the wax is preferably from 0.5 mass parts to 20.0 mass parts per 100 mass parts of the binder resin.

Insofar as the characteristics or effects are not impaired, various organic or inorganic fine particles may be externally added to the toner particle for the toner. The following, for example, may be used for these organic or inorganic fine particles.

(1) Flowability-imparting agents: silica, alumina, titanium oxide, carbon black, and fluorinated carbon (2) Abrasives: metal oxides (for example, strontium titanate, cerium oxide, alumina, magnesium oxide, chromium oxide), nitrides (for example, silicon nitride), carbides (for example, silicon carbide), metal salts (for example, calcium sulfate, barium sulfate, calcium carbonate)

(3) Lubricants: fluororesin fine particles (for example, vinylidene fluoride, polytetrafluoroethylene), metal salts of fatty acids (for example, zinc stearate, calcium stearate)

(4) Charge control particles: metal oxides (for example, tin oxide, titanium oxide, zinc oxide, silica, alumina), carbon black The organic or inorganic fine particles may also be subjected to a hydrophobic treatment. The treatment agent for performing the hydrophobic treatment on the organic or inorganic fine particles can be exemplified by unmodified silicone varnishes, various modified silicone varnishes, unmodified silicone oils, various modified silicone oils, silane compounds, silane coupling agents, organosilicon compounds other than the preceding, and organotitanium compounds. A single one of these treatment agents may be used or combinations may be used.

The methods used to measure the values of the various properties are described in the following.

Method for Measuring Weight-average Particle Diameter (D4) and Number-Average Particle Diameter (D1) of Toner Particle The weight-average particle diameter (D4) and the number-average particle diameter (D1) of the toner particle are determined as follows.

The measurement instrument used is a "Coulter Counter Multisizer 3" (registered trademark, Beckman Coulter, Inc.), a precision particle size distribution measurement instrument operating on the pore electrical resistance method and equipped with a 100-μm aperture tube. The measurement conditions are set and the measurement data are analyzed using the accompanying dedicated software, i.e., "Beckman Coulter Multisizer 3 Version 3.51" (Beckman Coulter, Inc.). The measurements are carried out in 25,000 channels for the number of effective measurement channels.

The aqueous electrolyte solution used for the measurements is prepared by dissolving special-grade sodium chloride in deionized water to provide a concentration of 1.0% and, for example, "ISOTON II" (Beckman Coulter, Inc.) can be used.

The dedicated software is configured as follows prior to measurement and analysis.

In the "modify the standard operating method (SOMME)" screen in the dedicated software, the total count number in the control mode is set to 50,000 particles; the number of measurements is set to 1 time; and the Kd value is set to the value obtained using "standard particle 10.0 μm" (Beckman Coulter, Inc.).

The threshold value and noise level are automatically set by pressing the "threshold value/noise level measurement button". In addition, the current is set to 1600 μA; the gain is set to 2; the electrolyte solution is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) 200.0 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture tube flush" function of the dedicated software.

(2) 30.0 mL of the aqueous electrolyte solution is introduced into a 100-mL flatbottom glass beaker. To this is added as dispersing agent 0.3 mL of a dilution prepared by the three-fold (mass) dilution with deionized water of "Contaminon N" (a 10% aqueous solution of a neutral pH 7 detergent for cleaning precision measurement instrumentation, comprising a nonionic surfactant, anionic surfactant, and organic builder, from Wako Pure Chemical Industries, Ltd.).

(3) An "Ultrasonic Dispersion System Tetra 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. 3.3 L of deionized water is introduced into the water tank of the ultrasound disperser and 2.0 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, 10 mg of the toner particle is added to the aqueous electrolyte solution in small aliquots and dispersion is carried out. The ultrasound dispersion treatment is continued for an additional 60 seconds. The water temperature in the water tank is controlled as appropriate during ultrasound dispersion to be from 10° C. to 40° C.

(6) Using a pipette, the dispersed toner particle-containing aqueous electrolyte solution prepared in (5) is dripped into the roundbottom beaker set in the sample stand as described in (1) with adjustment to provide a measurement concentration of 5%. Measurement is then performed until the number of measured particles reaches 50,000.

(7) The measurement data is analyzed by the previously cited dedicated software provided with the instrument and the weight-average particle diameter (D4) and the number-average particle diameter (D1) are calculated. When set to graph/volume % with the dedicated software, the "average diameter" on the "analysis/volumetric statistical value (arithmetic average)" screen is the weight-average particle diameter (D4). When set to graph/number % with the dedicated software, the "average diameter" on the "analysis/numerical statistical value (arithmetic average)" screen is the number-average particle diameter (D1).

Method for Measuring Glass Transition Temperature (Tg) of Toner Particle

The glass transition temperature (Tg) of the toner particle is measured using a differential scanning calorimeter (also referred to by "DSC" in the following).

Measurement of the glass transition temperature is performed by DSC in accordance with JIS K 7121 (nondomestic standard: ASTM D 3418-82).

A "Q1000" (TA Instruments) is used in this measurement, using the melting points of indium and zinc for temperature correction of the instrument detection section and using the heat of fusion of indium for correction of the amount of heat.

For the measurement, a 10 mg measurement sample is exactly weighed out and this is introduced into an aluminum pan; an empty aluminum pan is used for reference.

In a first ramp-up process, the measurement is run while heating the measurement sample from 20° C. to 200° C. at 10° C./min. This is followed by holding for 10 minutes at 200° C. and then the execution of a cooling process of cooling from 200° C. to 20° C. at 10° C./min.

After then holding for 10 minutes at 20° C., reheating from 20° C. to 200° C. at 10° C./min is carried out in a second ramp-up process.

The glass transition temperature here is the midpoint glass transition temperature. Using the DSC curve from the second ramp-up process as obtained under the measurement conditions described above, the glass transition temperature (Tg) is taken to be the temperature at the point where the curve segment for the stepwise change at the glass transition temperature intersects with the straight line that is equidistant, in the direction of the vertical axis, from the straight lines that extend the base lines on the low temperature side and high temperature side of the stepwise change.

When the toner particle has been produced, for example, in an aqueous medium, a portion is taken as a sample and the DSC measurement is run thereon after washing out other than the toner particle and drying.

Methods for Measuring Number-Average Particle Diameter of Fine Particles Containing Reaction Product of Polyhydric Acid and Group 4 Element-Containing Compound (1) For the Case in which the Fine Particles Containing the Reaction Product of a Polyhydric Acid and a Group 4 Element-Containing Compound can be Acquired The number-average particle diameter of the reaction product-containing fine particles is measured using a Zetasizer Nano-ZS (Malvern), and the measurement is carried out on an aqueous dispersion having a 1.0 mass % concentration of the fine particles containing the reaction product of a polyhydric acid and group 4 element-containing compound.

The measurement conditions are as follows.

cell: quartz glass cell
dispersant: water (dispersant RI: 1.330)
temperature: 25° C.
material RI: 1.60
result calculation: General Purpose (2) For the Case in which the Fine Particles Containing the Reaction Product of a Polyhydric Acid and a Group 4 Element-Containing Compound Cannot be Acquired The number-average particle diameter of the reaction product-containing fine particles is calculated based on observation of the toner particle surface.

Observation of the toner particle is carried out using an "S-4800" (Hitachi High-Technologies Corporation) ultra-high resolution field emission scanning electron microscope (also referred to as an FE-SEM in the following).

The observation conditions using the S-4800 are as follows.

Liquid nitrogen is introduced to the brim of the anti-contamination trap attached to the S-4800 housing and standing for 30 minutes is carried out.

The "PC-SEM" of the S-4800 is started and flashing is performed (the FE tip, which is the electron source, is cleaned). The acceleration voltage display area in the control panel on the screen is clicked and the [flashing] button is pressed to open the flashing execution dialog. A flashing intensity of 2 is confirmed and execution is carried out. The emission current due to flashing is confirmed to be 20 μA to 40 μA. The specimen holder is inserted in the specimen chamber of the S-4800 housing. [home] is pressed on the control panel to transfer the specimen holder to the observation position.

The acceleration voltage display area is clicked to open the HV setting dialog and the acceleration voltage is set to [2.0 kV] and the emission current is set to [10 μA].

Similarly, in the [base] tab of the operation panel, the probe current of the electron optical system condition block is set to [Normal]; the focus mode is set to [UHR]; and WD is set to [3.0 mm]. The [ON] button in the acceleration voltage display area of the control panel is pressed to apply the acceleration voltage.

After adjustment of the aperture alignment, the magnification is set to 100000× (100 k) and focusing is performed. Brightness adjustment is performed with mode, and an image with a size of 640×480 pixels is acquired.

The toner particle is observed and the particle diameter is calculated for the fine particles containing the reaction product of the polyhydric acid and group 4 element-containing compound, that are present on the toner particle surface. For a plurality of toner particles, the largest diameter is measured on 100 of the reaction product-containing fine particles, and the average value thereof is taken to be the number-average particle diameter of the fine particles containing the reaction product of the polyhydric acid and group 4 element-containing compound.

Method for Fluorescent X-Ray Measurement

Measurement of the fluorescent x-rays for each element is carried out based on JIS K 0119-1969 and specifically as follows.

An "Axios" wavelength-dispersive x-ray fluorescence analyzer (PANalytical B.V.) is used as the measurement instrumentation, and the "SuperQ ver. 4.0F" (PANalytical B.V.) software provided with the instrument is used in order to set the measurement conditions and analyze the measurement data.

Rh is used for the x-ray tube anode; a vacuum is used for the measurement atmosphere; the measurement diameter (collimator mask diameter) is 27 mm; and the measurement time is 10 seconds.

A proportional counter (PC) is used in the case of measurement of the light elements, and a scintillation counter (SC) is used in the case of measurement of the heavy elements.

4.0 g of the toner is introduced into a specialized aluminum compaction ring and is smoothed over, and, using a "BRE-32" tablet compression molder (Maekawa Testing Machine Mfg. Co., Ltd.), a pellet is produced by molding to a thickness of 2 mm and a diameter of 39 mm by compression for 60 seconds at 20 MPa, and this pellet is used as the measurement sample.

The measurement is performed using the conditions indicated above and the elements are identified based on the positions of the resulting x-ray peaks; their concentrations are calculated from the count rate (unit: cps), which is the number of x-ray photons per unit time.

EXAMPLES

The present invention is specifically described below using examples and comparative examples, but the present invention is not limited to or by these. Unless specifically indicated otherwise, the "parts" and "%" used for the materials in the examples and comparative examples are on a mass basis in all instances.

Toner Base Particle Dispersion 1 Production Example

Aqueous Medium 1 Production Example 390.0 parts of deionized water and 14.0 parts of sodium phosphate (dodecahydrate) [RASA Industries, Ltd.] were introduced into a reactor and the temperature was held at 65° C. for 1.0 hour while purging with nitrogen.

An aqueous calcium chloride solution of 9.2 parts calcium chloride (dihydrate) dissolved in 10.0 parts of deionized water was introduced all at once while stirring at 12,000 rpm using a T. K. Homomixer (Tokushu Kika Kogyo Co., Ltd.) to prepare an aqueous medium containing a dispersion stabilizer.

10% hydrochloric acid was introduced into this aqueous medium to adjust the pH to 6.0 and provide aqueous medium 1.

Polymerizable Monomer Composition 1 Production Example

| | |
|---|---|
| styrene | 60.0 parts |
| colorant (C.I. Pigment Blue 15:3) | 6.5 parts |

These materials are introduced into an attritor (Nippon Coke & Engineering Co., Ltd.) and dispersion was carried out for 5.0 hours at 220 rpm using zirconia particles with a diameter of 1.7 mm to prepare a dispersion 1 in which the colorant was dispersed.

The following materials were added to this dispersion 1.

| | |
|---|---|
| styrene | 20.0 parts |
| n-butyl acrylate | 20.0 parts |
| polyester resin (condensate of terephthalic acid/trimellitic acid/ 2 mol propylene oxide adduct on bisphenol A, glass transition temperature: 75° C.) | 5.0 parts |
| Fischer-Tropsch wax (melting point: 78° C.) | 7.0 parts |

This was then held at 65° C. and a polymerizable monomer composition 1 was prepared by dissolving and dispersing to uniformity at 500 rpm using a T. K. Homomixer.

Granulation Step

While holding the temperature of aqueous medium 1 at 70° C. and the stirrer rotation rate at 12,000 rpm, the polymerizable monomer composition 1 was introduced into the aqueous medium 1 and 9.0 parts of the polymerization initiator t-butyl peroxypivalate was added. Granulation was performed in this condition for 10 minutes while maintaining 12,000 rpm with the stirrer.

Polymerization Step

The high-speed stirrer was replaced with a stirrer equipped with a propeller impeller and polymerization was carried out for 5.0 hours while maintaining 70° C. and stirring at 150 rpm. An additional polymerization reaction was run by raising the temperature to 85° C. and heating for 2.0 hours to obtain toner base particle dispersion 1.

The toner base particles in the toner base particle dispersion 1 had a weight-average particle diameter (D4) of 6.7 μm, a number-average particle diameter (D1) of 5.3 μm, and a glass transition temperature (Tg) of 56° C.

Deionized water was added to adjust the toner base particle concentration in the toner base particle dispersion 1 to 20.0%.

Toner Base Particle Dispersion 2 Production Example

Resin Particle Dispersion Production Example

The following materials were weighed out and mixed and dissolved.

| | |
|---|---|
| styrene | 82.6 parts |
| n-butyl acrylate | 9.2 parts |
| acrylic acid | 1.3 parts |
| hexanediol diacrylate | 0.4 parts |
| n-lauryl mercaptan | 3.2 parts |

A 10% aqueous solution of Neogen RK (Dai-ichi Kogyo Seiyaku Co., Ltd.) was added to the resulting solution and dispersion was carried out. An aqueous solution of 0.15 parts of potassium persulfate dissolved in 10.0 parts of deionized water was added while gently stirring for 10 minutes. After substitution with nitrogen, an emulsion polymerization was run for 6.0 hours at a temperature of 70° C. After completion of the polymerization, the reaction solution was cooled to room temperature and deionized water was added to yield a resin particle dispersion having a solids concentration of 12.5% and a median diameter on a volume basis of 0.2 μm.

Wax Particle Dispersion Production Example

The following materials were weighed out and mixed.

| | |
|---|---|
| ester wax (melting point: 70° C.) | 100.0 parts |
| Neogen RK (Dai-ichi Kogyo Seiyaku Co., Ltd.) | 15.0 parts |
| deionized water | 385.0 parts |

These materials were dispersed for 1 hour using a JN100 wet jet mill (Jokoh Co., Ltd.) to yield a wax particle dispersion. The wax solids concentration in this wax particle dispersion was 20.0%.

Colorant Particle Dispersion Production Example

The following materials were weighed out and mixed.

| | |
|---|---|
| colorant (C.I. Pigment Blue 15:3) | 100.0 parts |
| Neogen RK (Dai-ichi Kogyo Seiyaku Co., Ltd.) | 15.0 parts |
| deionized water | 885.0 parts |

These materials were dispersed for 1 hour using a JN100 wet jet mill (Jokoh Co., Ltd.) to yield a colorant particle dispersion.

| | |
|---|---|
| resin particle dispersion | 160.0 parts |
| wax particle dispersion | 10.0 parts |
| colorant particle dispersion | 10.0 parts |
| magnesium sulfate | 0.2 parts |

These materials were dispersed using a homogenizer (Ultra-Turrax T50, IKA), followed by heating to 65° C. while stirring.

After stirring for 1.0 hour at 65° C. had been carried out, observation with an optical microscope confirmed the formation of aggregated particles having a number-average particle diameter of 6.0 μm.

To this was then added 2.2 parts of Neogen RK (Dai-ichi Kogyo Seiyaku Co., Ltd.), followed by heating to 80° C. and stirring for 2.0 hours to obtain fused spherical toner base particles.

The solid provided by cooling, filtration, and separation was washed by stirring for 1.0 hour with 720.0 parts of deionized water. The solution containing the toner base particles was filtered and a toner base particle 2 was obtained by drying using a vacuum dryer. Toner base particle 2 had a weight-average particle diameter (D4) of 7.1 μm, a number-average particle diameter (D1) of 5.6 μm, and a glass transition temperature (Tg) of 58° C.

390.0 parts of deionized water and 14.0 parts of sodium phosphate (dodecahydrate) [RASA Industries, Ltd.] were introduced into a container and the temperature was held at 65° C. for 1.0 hour while purging with nitrogen.

An aqueous calcium chloride solution of 9.2 parts calcium chloride (dihydrate) dissolved in 10.0 parts of deionized water was introduced all at once while stirring at 12,000 rpm using a T. K. Homomixer to prepare an aqueous medium containing a dispersion stabilizer.

10% hydrochloric acid was introduced into this aqueous medium to adjust the pH to 6.0 and provide aqueous medium 2.

100.0 parts of toner base particle 2 was introduced into aqueous medium 2 and dispersion was carried out for 15 minutes while stirring at 5,000 rpm and a temperature of 60° C. using a T. K. Homomixer. Deionized water was added to adjust the toner base particle concentration in the dispersion to 20.0%, thus providing toner base particle dispersion 2.

Toner Base Particle Dispersion 3 Production Example 660.0 parts of deionized water and 25.0 parts of a 48.5% aqueous solution of sodium dodecyldiphenyl ether disulfonate were mixed, and an aqueous medium 3 was prepared by stirring at 10,000 rpm using a T. K. Homomixer.

The following materials were introduced into 500.0 parts of ethyl acetate and a solution was prepared by dissolving at 100 rpm using a propeller stirrer.

| | |
|---|---|
| styrene/butyl acrylate copolymer (copolymerization mass ratio: 80/20) | 100.0 parts |
| saturated polyester resin (condensate of terephthalic acid with bisphenol A/2 mol propylene oxide adduct) | 3.0 parts |
| colorant (C.I. Pigment Blue 15:3) | 6.5 parts |
| Fischer-Tropsch wax (melting point: 78° C.) | 9.0 parts |

150.0 parts of aqueous medium 3 was introduced into a container; stirring was carried out at 12,000 rpm using a T. K. Homomixer; 100.0 parts of the aforementioned solution was added; and mixing was performed for 10 minutes to prepare an emulsion slurry.

100.0 parts of the emulsion slurry was subsequently introduced into a flask equipped with a degassing line, stirrer, and thermometer; the solvent was removed under reduced pressure for 12 hours at 30° C. while stirring at 500 rpm; and maturation was carried out for 4 hours at 45° C. to provide a desolvented slurry.

The desolvented slurry was subjected to vacuum filtration; 300.0 parts of deionized water was added to the resulting filter cake; mixing and redispersion were performed using a T. K. Homomixer (10 minutes at 12,000 rpm); and filtration was then carried out.

The resulting filter cake was dried for 48 hours at 45° C. using a dryer followed by screening across a mesh with an aperture of 75 μm to obtain toner base particle 3. Toner base particle 3 had a weight-average particle diameter (D4) of 6.9 μm, a number-average particle diameter (D1) of 5.5 μm, and a glass transition temperature (Tg) of 55° C.

390.0 parts of deionized water and 14.0 parts of sodium phosphate (dodecahydrate) [RASA Industries, Ltd.] were introduced into a container and the temperature was held at 65° C. for 1.0 hour while purging with nitrogen.

An aqueous calcium chloride solution of 9.2 parts calcium chloride (dihydrate) dissolved in 10.0 parts of deionized water was introduced all at once while stirring at 12,000 rpm using a T. K. Homomixer to prepare an aqueous medium containing a dispersion stabilizer.

10% hydrochloric acid was introduced into this aqueous medium to adjust the pH to 6.0 and provide an aqueous medium. 100.0 parts of toner base particle 3 was introduced into the obtained aqueous medium and dispersion was carried out for 15 minutes while stirring at 5,000 rpm and a temperature of 60° C. using a T. K. Homomixer. Deionized water was added to adjust the toner base particle concentration in the dispersion to 20.0%, thus providing toner base particle dispersion 3.

Toner Base Particle Dispersion 4 Production Example

The following materials were introduced into a reactor fitted with a condenser, stirrer, and nitrogen introduction line.

| | |
|---|---|
| terephthalic acid | 29.0 parts |
| polyoxypropylene(2.2)-2,2-bis(4-hydroxyphenyl)propane | 80.0 parts |
| titanium dihydroxybis(triethanolaminate) | 0.1 parts |

This was followed by heating to 200° C. and reaction for 9 hours while introducing nitrogen and removing the evolved water. 5.8 parts of trimellitic anhydride was then added; heating to 170° C. was carried out; and a polyester resin was synthesized by reaction for 3 hours.

In addition,

| | |
|---|---|
| low-density polyethylene (melting point: 100° C.) | 20.0 parts |
| styrene | 64.0 parts |
| n-butyl acrylate | 13.5 parts |
| acrylonitrile | 2.5 parts |

were introduced into an autoclave and the interior was substituted with nitrogen and holding at 180° C. was carried out while heating and stirring.

50.0 parts of a 2.0% xylene solution of t-butyl hydroperoxide was continuously added dropwise over 4.5 hours to the system, and, after cooling, the solvent was separated and removed to yield a graft polymer in which a copolymer was grafted on polyethylene.

| | |
|---|---|
| polyester resin | 100.0 parts |
| paraffin wax (melting point: 75° C.) | 5.0 parts |
| graft polymer | 5.0 parts |
| C.I. Pigment Blue 15:3 | 5.0 parts |

These materials were thoroughly mixed using an FM mixer (Model FM-75, Nippon Coke & Engineering Co., Ltd.) followed by melt-kneading with a twin-screw kneader (Model PCM-30, Ikegai Ironworks Corporation) set to a temperature of 100° C.

The resulting kneaded material was cooled and was coarsely pulverized to 1 mm and below using a hammer mill to yield a coarse pulverizate.

A finely pulverized material of about 5 μm was then obtained from this coarse pulverizate using a Turbo Mill from Turbo Kogyo Co., Ltd. (T-250: RSS rotor/SNB liner).

The fines and coarse powder were subsequently cut using a Coanda effect-based multi-grade classifier to obtain a toner base particle 4.

Toner base particle 4 had a weight-average particle diameter (D4) of 6.4 μm, a number-average particle diameter (D1) of 5.2 μm, and a glass transition temperature (Tg) of 59° C.

390.0 parts of deionized water and 14.0 parts of sodium phosphate (dodecahydrate) [RASA Industries, Ltd.] were introduced into a container and the temperature was held at 65° C. for 1.0 hour while purging with nitrogen.

An aqueous calcium chloride solution of 9.2 parts calcium chloride (dihydrate) dissolved in 10.0 parts of deionized water was introduced all at once while stirring at 12,000 rpm using a T. K. Homomixer to prepare an aqueous medium containing a dispersion stabilizer.

10% hydrochloric acid was introduced into this aqueous medium to adjust the pH to 6.0 and provide aqueous medium 4.

200.0 parts of toner base particle 4 was introduced into aqueous medium 4 and dispersion was carried out for 15 minutes while stirring at 5,000 rpm and a temperature of 60° C. using a T. K. Homomixer. Deionized water was added to adjust the toner base particle concentration in the dispersion to 20.0%, thus providing toner base particle dispersion 4.

Organosilicon Compound Solution 1 Production Example

| | |
|---|---|
| deionized water | 90.0 parts |
| methyltrimethoxysilane | 10.0 parts |

These materials were weighed into a 200-mL beaker and the pH was adjusted to 4.5 using 1 mol/L hydrochloric acid. This was followed by stirring for 1 hour while heating to 60° C. in a water bath to produce an organosilicon compound solution 1.

Toner 1 Production Example

The following materials were weighed into a reactor and mixed using a propeller impeller.

| | |
|---|---|
| organosilicon compound solution 1 | 20.0 parts |
| titanium lactate (TC-310, Matsumoto Fine Chemical Co., Ltd.) | 0.05 parts |
| toner base particle dispersion 1 | 500.0 parts |

The pH of the resulting mixture was then adjusted to 7.0 and the temperature of the mixture was brought to 50° C. and holding was then carried out for 1 hour while mixing using the propeller impeller.

The pH was subsequently adjusted to 9.5 using a 1 mol/L aqueous NaOH solution and holding was carried out for 2 hours while stirring at a temperature of 50° C.

The pH was adjusted to 1.5 with 1 mol/L hydrochloric acid and stirring was performed for 1 hour followed by filtration while washing with deionized water to obtain a toner particle 1 having on its surface fine particles containing the reaction product of phosphoric acid and a titanium-containing compound.

These fine particles contained the reaction product of titanium lactate (titanium-containing compound) and the phosphate ion (polyhydric acid) derived from the sodium phosphate or calcium phosphate present in aqueous medium 1.

The number-average particle diameter of these fine particles according to observation with a field emission scanning electron microscope (FE-SEM) was 2 nm.

On the other hand, the content in the toner particle of the reaction product of phosphoric acid and the titanium-containing compound was 0.01 mass % by x-ray fluorescence. The obtained toner particle 1 was designated toner 1.

Toner 2 Production Example

A toner particle 2 having on its surface fine particles containing the reaction product of phosphoric acid and a titanium-containing compound was obtained proceeding as in the Toner 1 Production Example with the following exceptions: (1) the organosilicon compound solution 1 was not used; (2) the amount of titanium lactate addition was changed from 0.05 parts to 0.18 parts; and (3) the temperature of the mixture was changed from 50° C. to 85° C. and subsequent to this the pH was adjusted to 9.5 and stirring was performed at a temperature of 85° C.

The number-average particle diameter of the fine particles was 5 nm according to FE-SEM observation.

On the other hand, the content in the toner particle of the reaction product of phosphoric acid and the titanium-containing compound was 0.05 mass % by x-ray fluorescence. The obtained toner particle 2 was designated toner 2.

Toner 3 Production Example

A toner particle 3 having on its surface fine particles containing the reaction product of phosphoric acid and a titanium-containing compound was obtained proceeding as in the Toner 1 Production Example, but changing the 0.05 parts of titanium lactate (TC-310, Matsumoto Fine Chemical Co., Ltd.) to 0.85 parts of the ammonium salt of titanium lactate (TC-300, Matsumoto Fine Chemical Co., Ltd.).

FIG. 1 gives a photograph of toner particle 3 taken using a field emission scanning electron microscope (FE-SEM).

The number-average particle diameter of the fine particles was 12 nm according to FE-SEM observation.

On the other hand, the content in the toner particle of the reaction product of phosphoric acid and the titanium-containing compound was 0.20 mass % by x-ray fluorescence. The obtained toner particle 3 was designated toner 3.

Toner 4 Production Example

The following materials were weighed into a reactor and mixed using a propeller impeller.

| | |
|---|---|
| organosilicon compound solution 1 | 20.0 parts |
| sodium phosphate dodecahydrate | 5.0 parts |
| titanium triethanolaminate (TC-400, Matsumoto Fine Chemical Co., Ltd.) | 1.7 parts |
| toner base particle dispersion 1 | 500.0 parts |

The pH of the resulting mixture was then adjusted to 7.0 and the temperature of the mixture was brought to 50° C. and holding was carried out for 1 hour while mixing using the propeller impeller.

The pH was then adjusted to 9.5 using a 1 mol/L aqueous NaOH solution and holding was carried out for 2 hours while stirring at a temperature of 50° C.

The pH was adjusted to 1.5 with 1 mol/L hydrochloric acid and stirring was performed for 1 hour followed by filtration while washing with deionized water to obtain a toner particle 4 having on its surface fine particles containing the reaction product of phosphoric acid and a titanium-containing compound.

The number-average particle diameter of the fine particles was 51 nm according to FE-SEM observation.

On the other hand, the content in the toner particle of the reaction product of phosphoric acid and the titanium-containing compound was 0.50 mass % by x-ray fluorescence. The obtained toner particle 4 was designated toner 4.

These fine particles contained the reaction product of titanium triethanolaminate (titanium-containing compound) and the phosphate ion (polyhydric acid) derived from the sodium phosphate in the mixture.

Toner 5 Production Example

A toner particle 5 having on its surface fine particles containing the reaction product of phosphoric acid and a titanium-containing compound was obtained proceeding as in the Toner 1 Production Example, but with the supplemental addition of 18.0 parts of sodium phosphate dodecahydrate and changing the amount of titanium lactate addition from 0.05 parts to 10.0 parts.

The number-average particle diameter of the fine particles was 190 nm according to FE-SEM observation.

On the other hand, the content in the toner particle of the reaction product of phosphoric acid and the titanium-containing compound was 2.88 mass % by x-ray fluorescence. The obtained toner particle 5 was designated toner 5.

Toner 7 Production Example

A toner particle 7 having on its surface fine particles containing the reaction product of phosphoric acid and a zirconium-containing compound was obtained proceeding as in the Toner 1 Production Example, but changing the titanium lactate to 3.5 parts of the ammonium salt of zirconium lactate (ZC-300, Matsumoto Fine Chemical Co., Ltd.).

The number-average particle diameter of the fine particles was 32 nm according to FE-SEM observation.

On the other hand, the content in the toner particle of the reaction product of phosphoric acid and the zirconium-containing compound was 0.21 mass % by x-ray fluorescence. The obtained toner particle 7 was designated toner 7.

Toner 14 Production Example

The following materials were weighed into a reactor and mixed using a propeller impeller.

| | |
|---|---|
| titanium isopropoxide | 2.4 parts |
| toner base particle dispersion 1 | 500.0 parts |

The pH of the resulting mixture was then adjusted to 7.0 and the temperature of the mixture was brought to 85° C. and holding was carried out for 1 hour while mixing using the propeller impeller.

The pH was adjusted to 1.5 with 1 mol/L hydrochloric acid and stirring was performed for 1 hour followed by filtration while washing with deionized water to obtain a toner particle 14 having on its surface fine particles containing a titanium oxide compound.

The number-average particle diameter of the fine particles was 52 nm according to FE-SEM observation.

On the other hand, the content in the toner particle of the titanium oxide compound was 0.52 mass % by x-ray fluorescence. The obtained toner particle 14 was designated toner 14.

Fine Particle 1 Production Example

| | |
|---|---|
| deionized water | 100.0 parts |
| sodium phosphate (dodecahydrate) [RASA Industries, Ltd.] | 8.5 parts |

The preceding materials were mixed and 10.0 parts of titanium lactate (TC-310, Matsumoto Fine Chemical Co., Ltd.) was then added while stirring at 10,000 rpm using a T. K. Homomixer (Tokushu Kika Kogyo Co., Ltd.) at room temperature. The pH was adjusted to 7.0 by the addition of 1 mol/L hydrochloric acid.

The solids fraction was subsequently recovered by centrifugal separation. Ions such as sodium and so forth were removed by then carrying out the following sequence three times: redispersion in deionized water and recovery of the solids fraction by centrifugal separation. This was followed by redispersion in deionized water and drying by spray drying to obtain fine particles having a number-average particle diameter of 310 nm and containing the reaction product of phosphoric acid and the titanium-containing compound.

Fine Particles 2 to 6 Production Example

Fine particles 2 to 6 were obtained proceeding as in the Fine Particle 1 Production Example, but changing, as shown in Table 1, the sodium phosphate (dodecahydrate) used as the polyhydric acid, the titanium lactate used as the group 4 element-containing compound, and the rotation rate for the T. K. Homomixer.

1 mol/L hydrochloric acid or a 1 mol/L aqueous solution of sodium hydroxide was used to adjust the pH.

TABLE 1

| fine particle No. | polyhydric acid | amount of addition [parts] | group 4 element-containing compound | amount of addition [parts] | rotation rate [rpm] | type of fine particle | number-average particle diameter [nm] |
|---|---|---|---|---|---|---|---|
| 1 | sodium phosphate dodecahydrate | 8.5 | titanium lactate | 10.0 | 10000 | reaction product of phosphoric acid and titanium-containing compound | 310 |
| 2 | sodium sulfate | 4.8 | titanium lactate | 10.0 | 13000 | reaction product of sulfuric acid and titanium-containing compound | 108 |
| 3 | sodium carbonate | 3.6 | ammonium salt of titanium lactate | 12.0 | 13000 | reaction product of carbonic acid and titanium-containing compound | 98 |
| 4 | sodium sulfate | 4.8 | ammonium salt of zirconium lactate | 60.0 | 15000 | reaction product of sulfuric acid and zirconium-containing compound | 124 |
| 5 | sodium carbonate | 3.6 | ammonium salt of zirconium lactate | 60.0 | 15000 | reaction product of carbonic acid and zirconium-containing compound | 84 |
| 6 | trimellitic anhydride | 4.3 | titanium triethanolaminate | 10.0 | 13000 | reaction product of trimellitic acid and titanium-containing compound | 112 |

The manufacturers and product names for the compounds in the table are as follows.

titanium lactate: "TC-310", Matsumoto Fine Chemical Co., Ltd.

ammonium salt of titanium lactate: "TC-300", Matsumoto Fine Chemical Co., Ltd.

ammonium salt of zirconium lactate: "TZ-300", Matsumoto Fine Chemical Co., Ltd.

titanium triethanolaminate: "TC-400", Matsumoto Fine Chemical Co., Ltd.

Toner 6 Production Example

The pH of toner base particle dispersion 1 was adjusted to 1.5 by the addition thereto of 1 mol/L hydrochloric acid; stirring was performed for 1 hour; filtration was then carried out while washing with deionized water; and drying using a vacuum dryer gave a toner base particle 1.

A toner particle 6 was obtained by mixing, using an FM mixer (Nippon Coke & Engineering Co., Ltd.), 5.0 parts of fine particle 1 with 100.0 parts of toner base particle 1.

The amount in the toner particle of the reaction product of phosphoric acid and the titanium-containing compound was 4.9 mass % by x-ray fluorescence. The obtained toner particle 6 was designated toner 6.

Toners 8 to 13 and 15 Production Example

Toners 8 to 13 and 15 were obtained proceeding as in the Toner 6 Production Example, but changing a type of fine particle and an amount of fine particle given in Table 2.

TABLE 2

| toner No. | fine particle I | amount of addition [parts] | content [mass %] | fine particle II | amount of addition [parts] | content [mass %] |
|---|---|---|---|---|---|---|
| 6 | fine particle 1 | 5.0 | 4.9 | — | — | — |
| 8 | fine particle 2 | 0.5 | 0.5 | — | — | — |
| 9 | fine particle 3 | 0.5 | 0.5 | — | — | — |
| 10 | fine particle 4 | 0.5 | 0.5 | — | — | — |
| 11 | fine particle 5 | 0.5 | 0.5 | — | — | — |
| 12 | fine particle 6 | 0.5 | 0.5 | — | — | — |
| 13 | titanium oxide fine particles (number-average particle diameter = 28 nm) | 0.5 | 0.5 | — | — | — |
| 15 | tricalcium phosphate fine particles (number-average particle diameter = 482 nm) | 0.5 | 0.5 | silica fine particles (number-average particle diameter = 20 nm, treated with silicone oil) | 1.0 | 0.9 |

Examples 1 to 12 and Comparative Examples 1 to 3

The following evaluations were carried out using toners 1 to 15.

Using a color laser printer (LBP-7700C, Canon, Inc.), the toner was removed from the cyan cartridge and 160 g of the particular toner was filled into this cartridge. This filled cartridge was used to evaluate the charging performance and member contamination.

Evaluation of the Charge Rise Performance

The evaluation was run as follows in a low-temperature, low-humidity environment (10° C., 15% RH; also referred to as "L/L" in the following).

19.0 g of F813-300 magnetic carrier (Powdertech Co., Ltd.) and 1.0 g of the toner to be evaluated were introduced into a lidded 50-mL plastic bottle; two or these were prepared.

Shaking was performed for 3 minutes or 10 minutes, respectively, at a speed of 4 roundtrips per second using a shaker (YS-LD, YAYOI Co., Ltd.) to prepare two-component developers.

Figure 2:
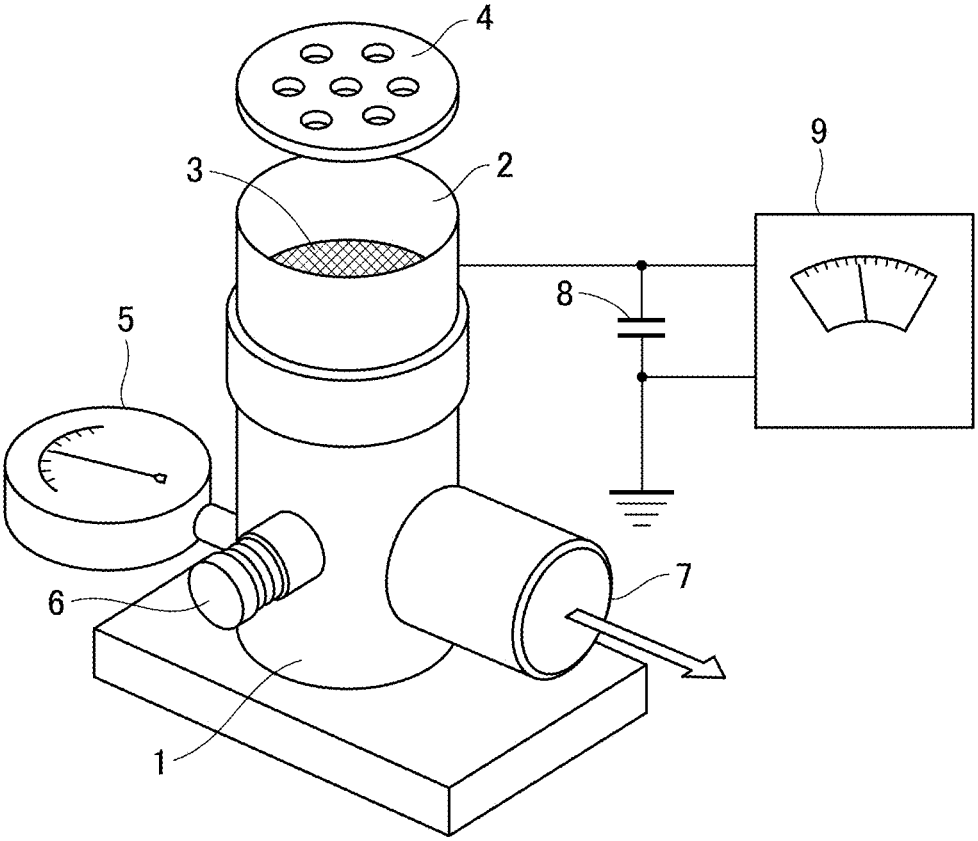
FIG. 2 is a schematic drawing of an instrument for measuring the charge quantity.

0.200 g of the two-component developer for measurement of the triboelectric charge quantity is introduced into a metal measurement container 2 having a 500-mesh screen 3 (25 μm aperture) at the bottom, as shown in FIG. 2, and a metal lid 4 is applied. The mass of the entire measurement container 2 at this point is measured to give W1 (g).

Suction is then drawn through a suction port 7 with a suction device 1 (the part in contact with the measurement container 2 is at least an insulator), and the pressure at a vacuum gauge 5 is brought to 50 mmAq by adjustment with an airflow control valve 6. The toner is suctioned and removed in this state for 1 minute.

The potential at an electrometer 9 at this point is indicated in volts (V). Here, 8 is a capacitor, and the capacitance is C (μg). The mass of the overall measurement container after suction is measured to give W2 (g). The triboelectric charge quantity of the toner is calculated using the following formula.

$$\text{triboelectric charge quantity (mC/kg)}=(C\times V)/(W1-W2)$$

The value of "triboelectric charge quantity after shaking for 3 minutes"/"triboelectric charge quantity after shaking for 10 minutes" was calculated, and this result was taken to be the charge rise performance and was evaluated using the following criteria. The results of the evaluation are given in Table 3.

A: the charge rise performance is at least 90%

B: the charge rise performance is at least 80%, but less than 90%

C: the charge rise performance is at least 70%, but less than 80%

D: the charge rise performance is less than 70%

Evaluation of Environmental Stability

The following evaluation was performed in a low-temperature, low-humidity environment (10° C., 15% RH) and in a high-temperature, high-humidity environment (30° C., 80% RH; also referred to as "H/H" in the following).

19.0 g of F813-300 magnetic carrier (Powdertech Co., Ltd.) and 1.0 g of the toner to be evaluated were introduced into a lidded 50-mL plastic bottle.

Shaking was performed for 10 minutes at a speed of 4 roundtrips per second using a shaker (YS-LD, YAYOI Co., Ltd.) to prepare a two-component developer.

The triboelectric charge quantity was measured proceeding as in the evaluation of the charge rise performance.

The value of "triboelectric charge quantity in the high-temperature, high-humidity environment"/"triboelectric charge quantity in the low-temperature, low-humidity environment" was calculated, and this result was taken to be the charge quantity stability with respect to the environment (environmental stability) and was evaluated using the following criteria. The results of the evaluation are given in Table 3.

A: the charge quantity stability is at least 90%

B: the charge quantity stability is at least 80%, but less than 90%

C: the charge quantity stability is at least 70%, but less than 80%

D: the charge quantity stability is less than 70%

TABLE 3

| | toner | triboelectric charge quantity (mC/kg) L/L | | H/H | charge rise | | charge quantity | |
|---|---|---|---|---|---|---|---|---|
| | No. | 3 minutes | 10 minutes | 10 minutes | performance | | stability | |
| Example 1 | 1 | 25 | 26 | 24 | 96% | A | 92% | A |
| Example 2 | 2 | 24 | 26 | 24 | 92% | A | 92% | A |
| Example 3 | 3 | 27 | 28 | 26 | 96% | A | 93% | A |
| Example 4 | 4 | 27 | 28 | 26 | 96% | A | 93% | A |
| Example 5 | 5 | 28 | 30 | 27 | 93% | A | 90% | A |
| Example 6 | 6 | 29 | 32 | 26 | 91% | A | 81% | B |
| Example 7 | 7 | 23 | 24 | 23 | 96% | A | 96% | A |
| Example 8 | 8 | 17 | 19 | 17 | 89% | B | 89% | B |
| Example 9 | 9 | 16 | 18 | 15 | 89% | B | 83% | B |
| Example 10 | 10 | 17 | 20 | 17 | 85% | B | 85% | B |
| Example 11 | 11 | 17 | 20 | 16 | 85% | B | 80% | B |
| Example 12 | 12 | 15 | 17 | 12 | 88% | B | 71% | C |
| Comparative Example 1 | 13 | 16 | 24 | 19 | 67% | D | 79% | C |
| Comparative Example 2 | 14 | 14 | 18 | 13 | 78% | C | 72% | C |
| Comparative Example 3 | 15 | 13 | 16 | 6 | 81% | B | 38% | D |

Evaluation of Charging Member Contamination

A loaded cartridge was installed in the cyan station of the aforementioned printer in the low-temperature, low-humidity environment (10° C., 15% RH). Using Office 70 A4 plain paper (Canon Marketing Japan Inc., 70 g/m$^2$), 2,000 prints were continuously output of a chart having a print percentage of 30%, while replenishing the toner; this was followed by the output of a halftone image.

Non-uniform charging is produced on the photosensitive member when charging member contamination is produced, and image density non-uniformity is then produced in the halftone image.

The evaluation criteria are as follows.

A: the halftone image is uniform and free of image density non-uniformity

B: a very slight image density non-uniformity is present in the halftone image

C: a slight image density non-uniformity is present in the halftone image

D: image density non-uniformity is present in the halftone image

The results of the evaluations are given in Table 4.

TABLE 4

| | toner No. | charging member contamination |
|---|---|---|
| Example 1 | 1 | A |
| Example 2 | 2 | A |
| Example 3 | 3 | A |
| Example 4 | 4 | A |
| Example 5 | 5 | A |
| Example 6 | 6 | B |
| Example 7 | 7 | A |
| Example 8 | 8 | A |
| Example 9 | 9 | A |
| Example 10 | 10 | A |
| Example 11 | 11 | A |
| Example 12 | 12 | B |
| Comparative Example 1 | 13 | C |
| Comparative Example 2 | 14 | D |
| Comparative Example 3 | 15 | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-11259, filed Jan. 26, 2018, which is hereby incorporated by reference herein in its entirety.

What is claimed is:

1. A toner, comprising:

a toner particle containing a binder resin, the toner particle having a surface comprising a reaction product of a polyhydric acid and a compound containing a group 4 element, wherein the polyhydric alcohol comprises at least one member selected from the group consisting of sulfuric acid, carbonic acid and phosphoric acid.

2. The toner according to claim 1, wherein the group 4 element includes at least one of titanium and zirconium.

3. The toner according to claim 1, wherein fine particles containing the reaction product are present on the toner particle surface, and the fine particles have a number-average particle diameter of 1 to 200 nm.

4. The toner according to claim 1, wherein the reaction product is at least one member selected from the group consisting of:

reaction products of sulfuric acid and a titanium-containing compound, reaction products of carbonic acid and a titanium-containing compound, reaction products of phosphoric acid and a titanium-containing compound, reaction products of sulfuric acid and a zirconium-containing compound, reaction products of carbonic acid and a zirconium-containing compound, and reaction products of phosphoric acid and a zirconium-containing compound.

5. The toner according to claim 4, wherein the reaction product comprises at least one member selected from the group consisting of:

reaction products of phosphoric acid and a titanium-containing compound, and reaction products of phosphoric acid and a zirconium-containing compound.

6. The toner according to claim 1, wherein the content of the reaction product in the toner particle is 0.01 to 5.00 mass %.

7. The toner according to claim 1, wherein the polyhydric acid comprises at least one member selected from the group consisting of carbonic acid, and phosphoric acid.

8. The toner according to claim 7, wherein the polyhydric acid comprises phosphoric acid.

* * * * *